US009607750B2

(12) United States Patent
Oughton, Jr. et al.

(10) Patent No.: US 9,607,750 B2
(45) Date of Patent: Mar. 28, 2017

(54) INDUCTOR SYSTEMS USING FLUX CONCENTRATOR STRUCTURES

(71) Applicant: Eaton Corporation, Cleveland, OH (US)

(72) Inventors: George W. Oughton, Jr., Raleigh, NC (US); Larry V. Lynam, Youngsville, NC (US); Thomas A. Wallace, Raleigh, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/790,612

(22) Filed: Mar. 8, 2013

(65) Prior Publication Data

US 2014/0176271 A1 Jun. 26, 2014

Related U.S. Application Data

(60) Provisional application No. 61/745,245, filed on Dec. 21, 2012.

(51) Int. Cl.
*H01F 17/06* (2006.01)
*H01F 27/30* (2006.01)
(Continued)

(52) U.S. Cl.
CPC ..... *H01F 27/08* (2013.01); *H01F 27/38* (2013.01); *H01F 27/2876* (2013.01); *H01F 27/325* (2013.01)

(58) Field of Classification Search
CPC ..... H01F 27/08
(Continued)

(56) References Cited

U.S. PATENT DOCUMENTS 4,238,753 A * 12/1980 Bayer ..... H01F 5/04 336/178
4,700,166 A * 10/1987 Bradt ..... H01F 27/306 29/606
(Continued)

FOREIGN PATENT DOCUMENTS

EP 1 178 501 A1 2/2002
WO WO 2008/008538 A2 1/2008

OTHER PUBLICATIONS

English translation of JP09069446.*
(Continued)

*Primary Examiner* — Elvin G Enad
*Assistant Examiner* — Ronald Hinson
(74) *Attorney, Agent, or Firm* — Ward and Smith, P.A.

(57) ABSTRACT

An apparatus (e.g., an inductor system) includes an elongate magnetic core, at least one coil wrapped around the magnetic core and a spacer configured to separate an inner side of the at least one coil from the magnetic core to provide a coolant passage between the inner side of the at least one coil and the magnetic core. The apparatus further includes at least one flux concentrator body positioned on an outer side of the at least one coil and configured to concentrate a magnetic flux on the outer side of the at least one coil. In some embodiments, the apparatus includes a frame configured to support the magnetic core, the at least one coil and the at least one flux concentrator body. In further embodiments, the at least one flux concentrator body may be mounted on at least one wall of an enclosure or chassis.

17 Claims, 12 Drawing Sheets

(51) Int. Cl.

| | |
|---|---|
| ***H01F 27/24*** | (2006.01) |
| ***H01F 27/08*** | (2006.01) |
| ***H01F 27/38*** | (2006.01) |
| *H01F 27/28* | (2006.01) |
| *H01F 27/32* | (2006.01) |

(58) Field of Classification Search
USPC ..... 336/178, 212
See application file for complete search history.

(56) References Cited

U.S. PATENT DOCUMENTS

| | | | | |
|---|---|---|---|---|
| 5,117,215 | A * | 5/1992 | Kakehashi | H01F 3/14 336/178 |
| 6,982,623 | B2 * | 1/2006 | Satou | H01F 3/10 336/178 |
| 7,205,875 | B2 | 4/2007 | Oughton, Jr. et al. | |
| 2004/0239464 | A1 | 12/2004 | Mihara et al. | |
| 2004/0263305 | A1 * | 12/2004 | Oughton, Jr. | H01F 27/085 336/55 |
| 2010/0214050 | A1 | 8/2010 | Opina, Jr. et al. | |
| 2012/0106207 | A1 | 5/2012 | Tsai et al. | |

OTHER PUBLICATIONS

Notification of Transmittal of the International Search Report and the Written Opinion of the International Searching Authority, or the Declaration, PCT/US2013/074856, Date of Mailing: Feb. 25, 2014; 10 pages.

* cited by examiner

INDUCTOR SYSTEMS USING FLUX CONCENTRATOR STRUCTURES

CROSS REFERENCE TO RELATED APPLICATION

This application claims the benefit of Provisional Application Ser. No. 61/745,245, Filed Dec. 21, 2012, entitled Inductor Systems Using Flux Concentrator Structures, the disclosure of which is hereby incorporated herein by reference in its entirety.

FIELD

The inventive subject matter relates to electromagnetic devices, and more particularly, to inductors and similar magnetic devices.

BACKGROUND

A high power converter application, such as a PWM-based uninterruptible power supply (UPS), may require low inductance/high current inductors for power conversion circuits, such as rectifiers and inverters. In such an application, it may be desirable to maintain useful inductance to 3 times the rated current. Operational currents may include both a 50/60 Hz power component and high frequency ripple currents.

Conventional inductor designs include closed flux path and gapped (discrete & distributed) core designs. Torroidal designs may require a complex winding design, and core heat may be trapped inside such a complex winding. Winding heat may further add to core temperature, and inner winding layers may be difficult to keep cool in such designs.

Gapped EE/EI or UU/UI designs often include a large core volume with a large air gap. Difficulties in cooling often drive toward the use of a ferrite core, which may be costly due to higher core volume.

Open flux path (e.g., air core) inductors may also be used. Simple air core designs may occupy a large volume to achieve a desired inductance, which can lead to high coil resistance and losses. Multiple layers can amplify skin and proximity effect losses and can impede cooling of inner layers. Losses often exceed acceptable levels, and the return flux path (thru surrounding air) may adversely affect nearby items. Escaping radiated fields may elevate EMI levels, and adjacent sensitive electronic circuits may respond adversely to this EMI.

U.S. Pat. No. 7,205,875 to Oughton et al. describes inductor structures for use in power converters and other applications that support air cooling and may be fabricated in a relatively cost-effective manner. As shown in FIGS. 1 and 2, such an inductor may include a ferrite magnetic core 13 supported in a bobbin-like frame 11 around which one or more coils 12 are wrapped. The bobbin 11 spaces the coil apart from the core 13 to provide a coolant passage that provides air flow between the core 13 and the coil 12.

SUMMARY

Some embodiments provide an apparatus including an elongate magnetic core, at least one coil wrapped around the magnetic core and a spacer configured to separate an inner side of the at least one coil from the magnetic core to provide a coolant passage between the inner side of the at least one coil and the magnetic core. The apparatus further includes at least one flux concentrator body positioned on an outer side of the at least one coil and configured to concentrate a magnetic flux on the outer side of the at least one coil. In some embodiments, the at least one flux concentrator body may include at least one discrete mass of magnetic material, such as at least one bar of magnetic material, positioned proximate the at least one coil. In some embodiments, the apparatus includes a frame configured to support the magnetic core, the at least one coil and the at least one flux concentrator body. In further embodiments, the at least one flux concentrator body may be mounted on at least one wall of an enclosure or chassis.

In some embodiments, the magnetic core may include a first bar of magnetic material, the at least one coil may be wrapped around an axis of the first bar of magnetic material and the at least one flux concentrator body may include at least one second bar of magnetic material positioned parallel to the first rectangular bar of magnetic material. For example, the first bar may include a first ferrite bar and the at least one second bar may include at least one second ferrite bar. In some embodiments, the first bar and/or the at least one second bar may be rectangular. In further embodiments, the at least one flux concentrator body may include at least one arcuate shell of magnetic material at least partially encircling the at least one coil and the bar of magnetic material.

Further embodiments of the inventive subject matter provide an apparatus including an inductor comprising an elongate magnetic core, a frame configured to support the magnetic core and at least one coil wrapped around the frame such that the frame separates an inner side of the at least one coil from the magnetic core to provide a coolant passage between the at least one coil and the magnetic core. The apparatus further includes at least one flux concentrator body positioned on an outer side of the at least one coil and configured to concentrate magnetic flux on the outer side of the at least one coil. The at least one flux concentrator body may be supported by the frame.

In some embodiments, the at least one flux concentrator body may include two flux concentrator bodies positioned on opposite sides of the magnetic core. In some embodiments, the elongate magnetic core may include a first bar of magnetic material, the at least one coil may be wrapped around a longitudinal axis of the first bar and the at least one flux concentrator body may include at least one second bar of magnetic material positioned parallel to the first bar of magnetic material. In further embodiments, the first bar may include a first ferrite bar and the at least one second bar may include a second ferrite bar. The first bar and/or the at least one second bar may be rectangular. In some embodiments, the at least one flux concentrator body may include at least one arcuate shell of magnetic material at least partially encircling the at least one coil and the bar of magnetic material. In some embodiments, the at least one flux concentrator body may be mounted on at least one wall of an enclosure or chassis.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
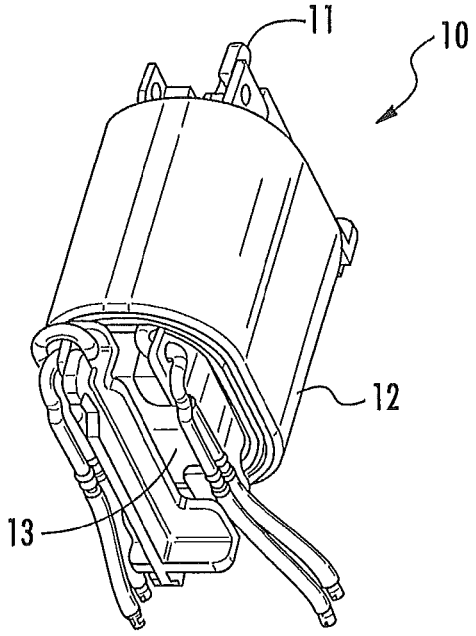
FIG. 1 PRIOR ART
FIGS. 1 and 2 illustrate a prior art inductor.

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will be further understood that elements "coupled in series" or "serially connected" may be directly coupled or may be coupled via intervening elements.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

Figure 2:
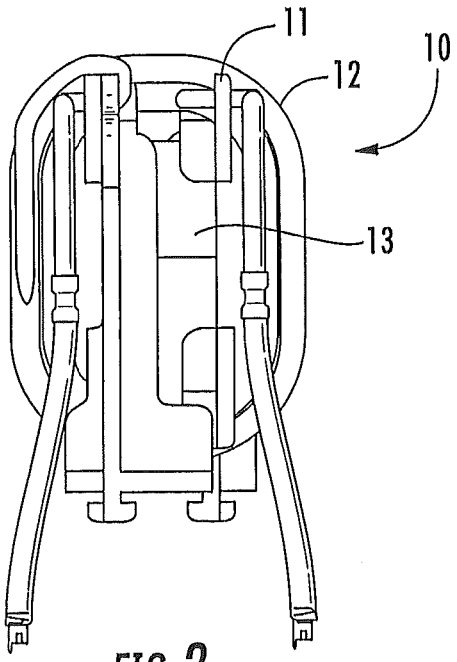
FIG. 2 PRIOR ART
Figure 3:
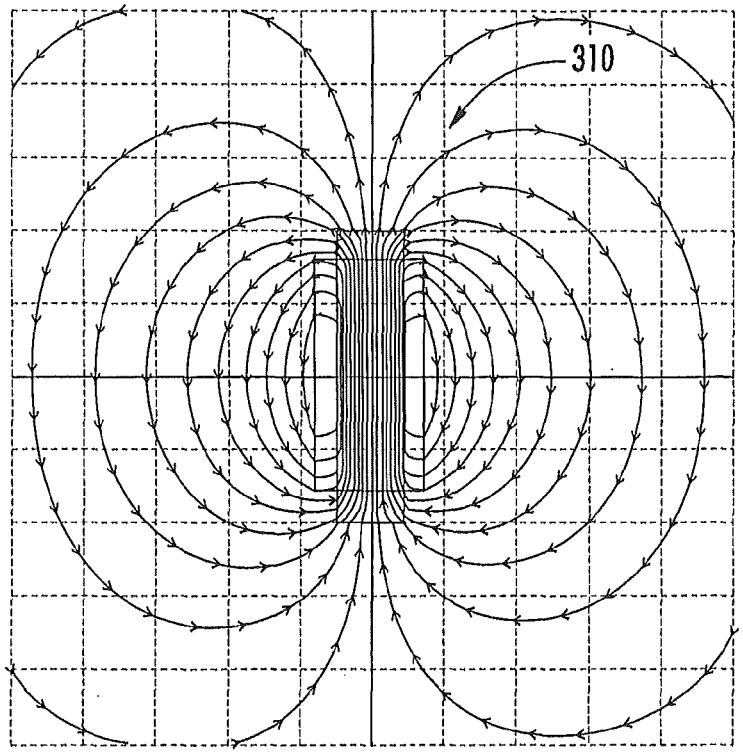
FIGS. 3 and 4 illustrate simulations of magnetic fields produced by inductors having a structure similar to the inductor of FIGS. 1 and 2.
Figure 4:
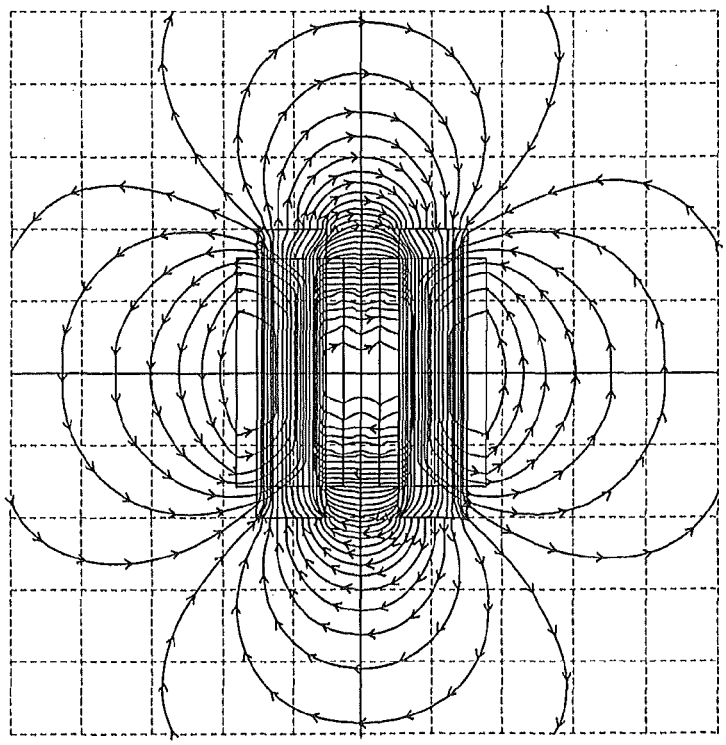

FIG. 3 illustrates a simulation of a magnetic field of an inductor 310 having a structure similar to the inductor of FIGS. 1 and 2. As can be seen, flux lines away from the inductor 310 are relatively widely spaced. The relatively unconstrained magnetic field may result in less than desired inductance and may induce eddy currents in surrounding structures. For example, if such an inductor is placed in close proximity to sheet metal, such as is commonly used in electronics chassis or enclosures, large currents in the inductor may induce relatively large eddy currents in the sheet metal and cause significant eddy current heating and power loss. Referring to FIG. 4, placing matched inductors in an antiparallel arrangement (flux paths in opposite directions) may concentrate the magnetic field due to flux linkage between the inductor cores, and may thus increase the inductance of each inductor and reduce eddy current heating in nearby sheet metal.

Some embodiments of the inventive subject matter arise from a realization that improved performance of an inductor having an air-hybrid core arrangement along the lines discussed above may be achieved in a flexible and potentially low cost manner by positioning a least one body of magnetic material proximate the inductor to act as a flux concentrator. The flux concentrator body may be, for example, a bar of ferrite or other magnetic material that is supported by the inductor structure and/or by a nearby structure, such as an enclosure or chassis wall.

Figure 5:
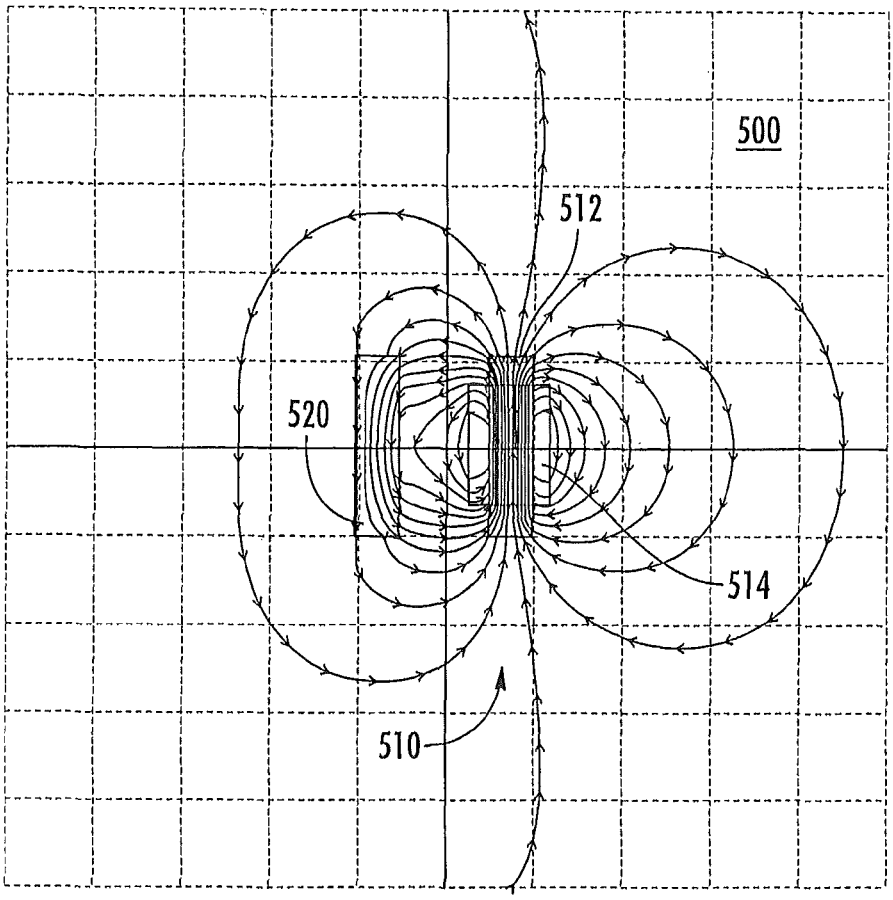
FIG. 5 illustrates a simulation of a magnetic field of an inductor system with a flux concentrator according to some embodiments of the inventive subject matter.

FIG. 5 illustrates an inductor system 500 according to some embodiments of the inventive subject matter. The inductor system 500 includes an inductor 510 and an associated flux concentrator body 520. The inductor 510 includes an elongate magnetic core 512, around which is wrapped at least one coil 514 such that magnetic core is positioned inside the at least one coil 514. The inductor 510 may have, for example, a structure similar to the inductor shown in FIGS. 1 and 2. The flux concentrator body 520 may be, for example, a bar of relatively high-permeability magnetic material, such as a ferrite bar, and is positioned proximate the inductor 510, on an outer side of the at least one coil 514. As shown in FIG. 5, the flux concentrator body 520 may concentrate magnetic flux created by the inductor 510 and thereby reduce stray flux that may impinge on adjacent metal structures, such as sheet metal walls. This may increase the inductance of the inductor 510 relative to designs without such a flux concentrator body and may reduce eddy current heating in nearby structures.

Figure 6:
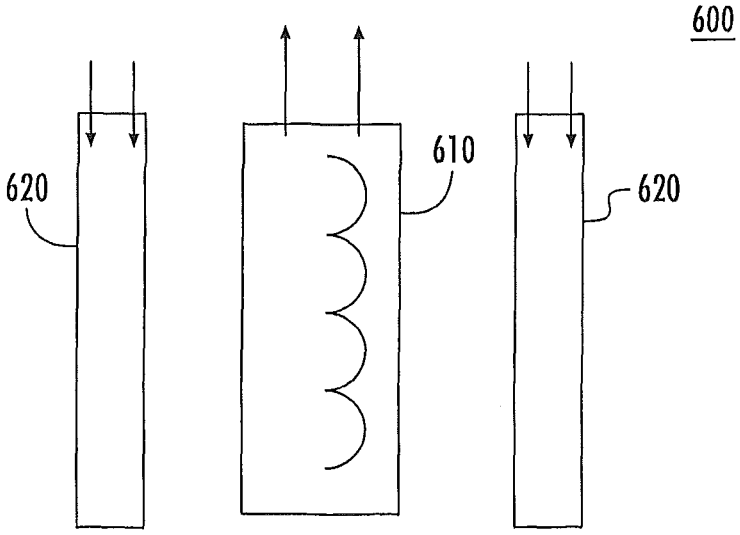
FIG. 6 illustrates an inductor system according to further embodiments of the inventive subject matter.
Figure 7:
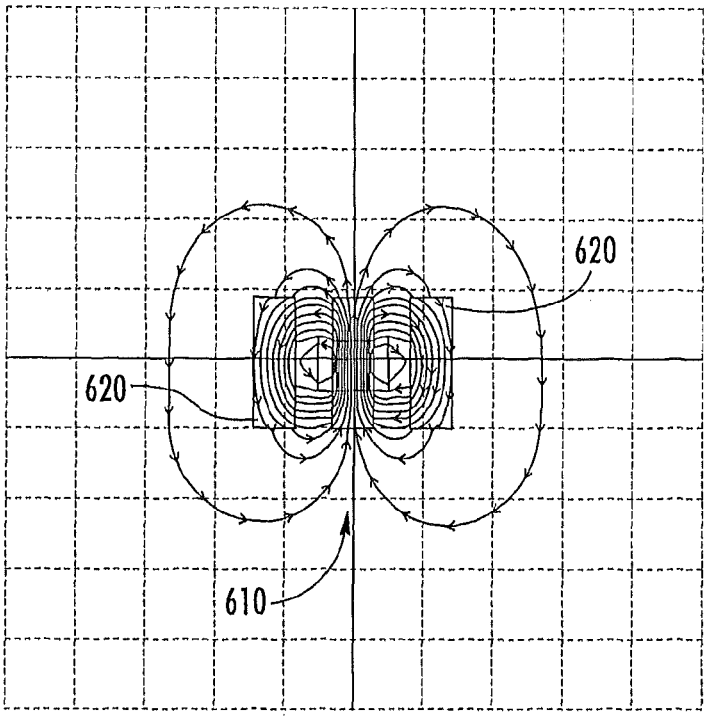
FIGS. 7-10 illustrate simulated magnetic fields for inductor systems according to various embodiments of the inventive subject matter.

FIG. 6 schematically illustrates an inductor system 600 according to further embodiments, wherein two flux concentrator bodies 620 are positioned on opposite sides of an inductor 610, such as the inductor shown in FIGS. 1 and 2. Referring to FIG. 7, the dual flux concentrator bodies 620 may cause near field concentration and far field attenuation on both sides of the inductor 610.

Figure 8:
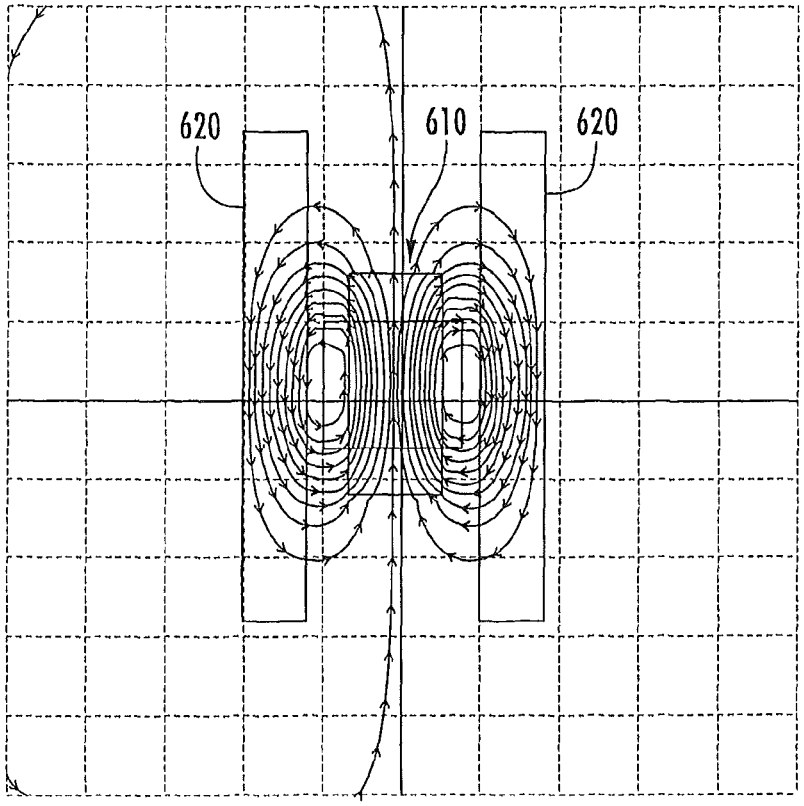
Figure 9:
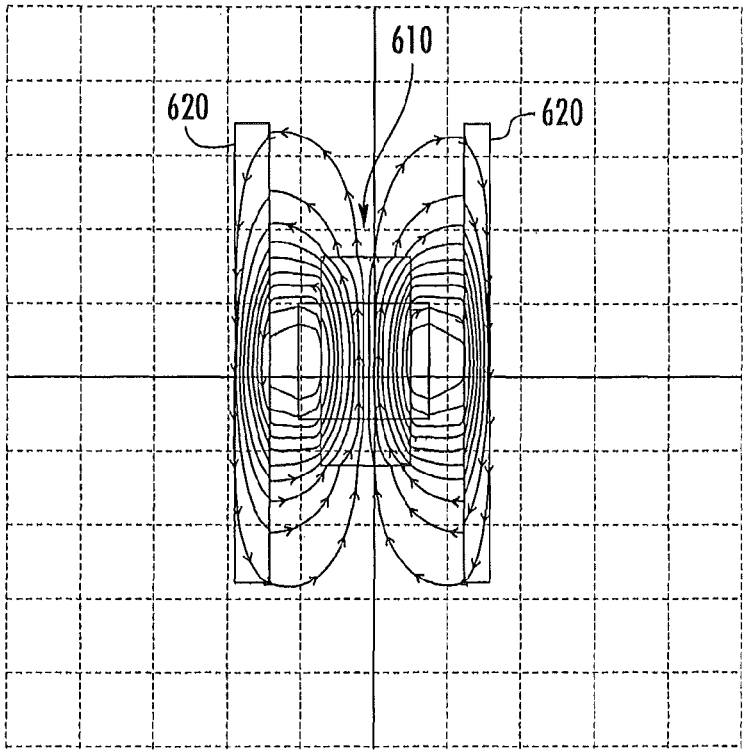
Figure 10:
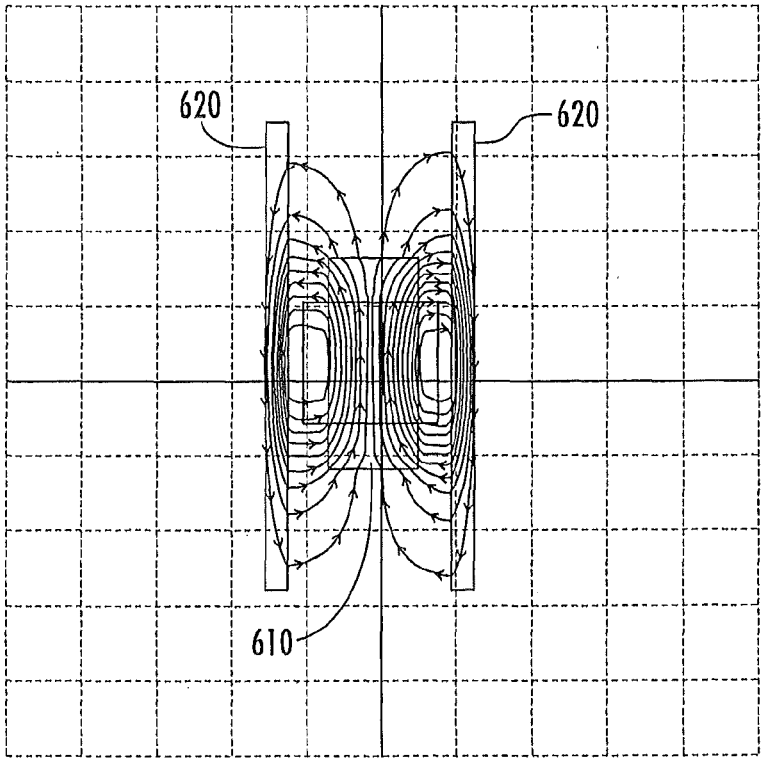

Referring to FIGS. 8-10, length and width of the flux concentrator bodies 620 may be varied to achieve desired performance within given space constraints. For example, as shown in FIG. 8, lengthening the flux concentrator bodies 620 may provide greater near field flux concentration (near the inductor) and greater far field attenuation. Referring to FIGS. 9 and 10, the use of dual flux concentrator bodies 620 may allow the thickness of the flux concentrator bodies 620 to be reduced in relation to the arrangement illustrated in FIG. 7. It will appreciated that the size and shape of such flux concentrator bodies may generally depend on available space, expected inductor currents and/or the materials used for the core of the inductor 610 and the flux concentrator bodies 620.

Figure 11:
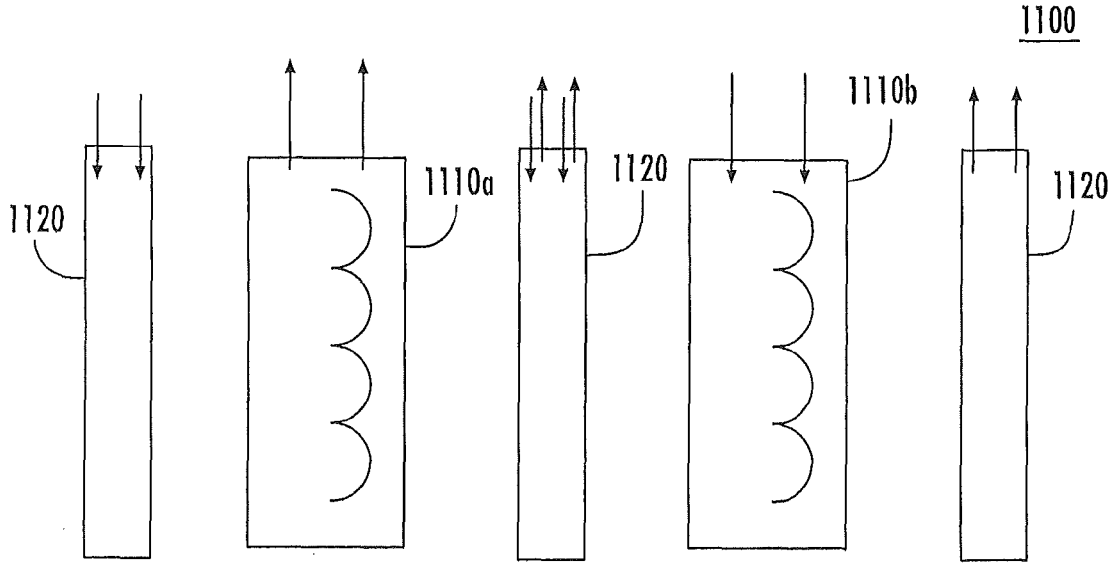
FIG. 11 illustrates a multiple inductor system according to some embodiments of the inventive subject matter.
Figure 12:
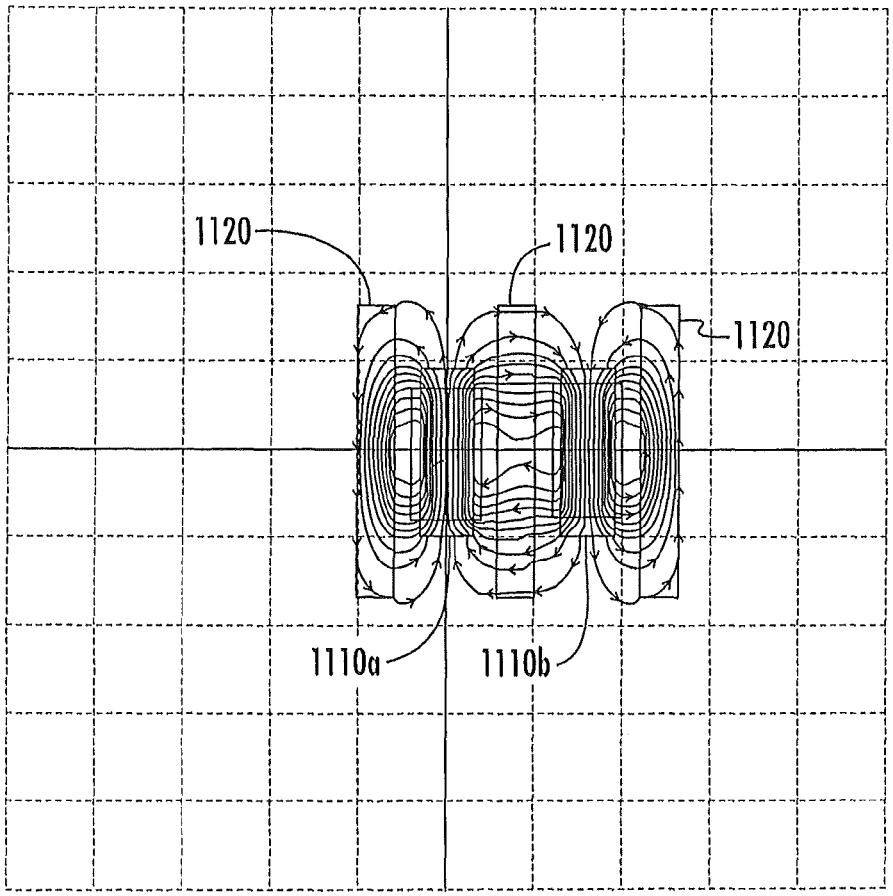
FIGS. 12 and 13 illustrate simulated magnetic fields for inductor systems according to various embodiments of the inventive subject matter.
Figure 13:
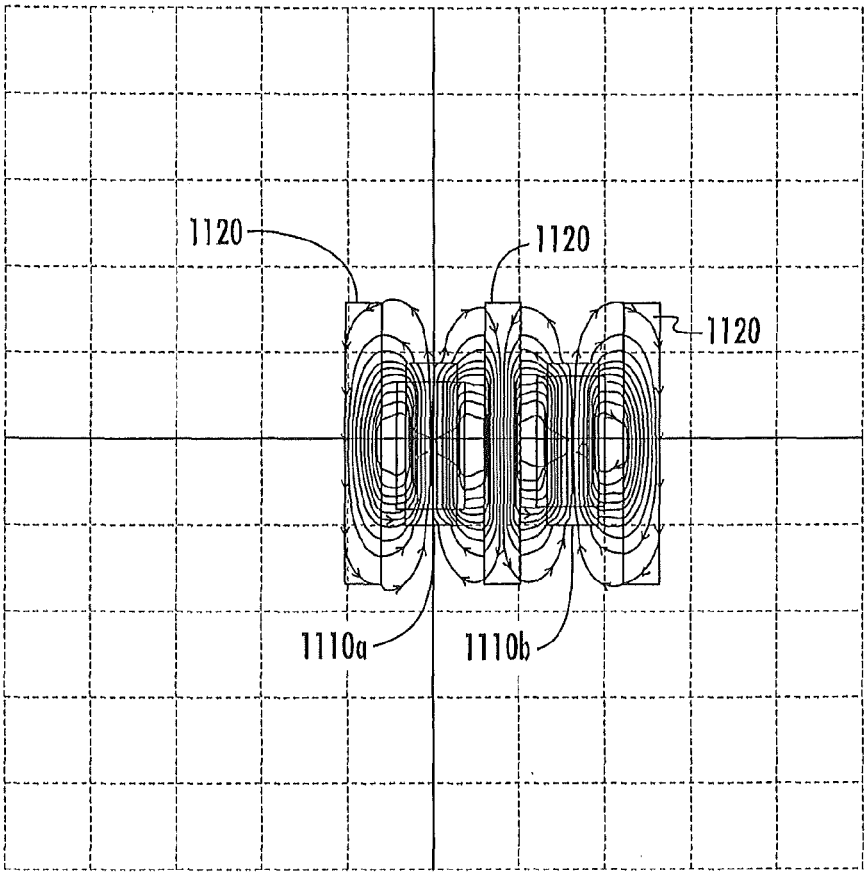
Figure 14:
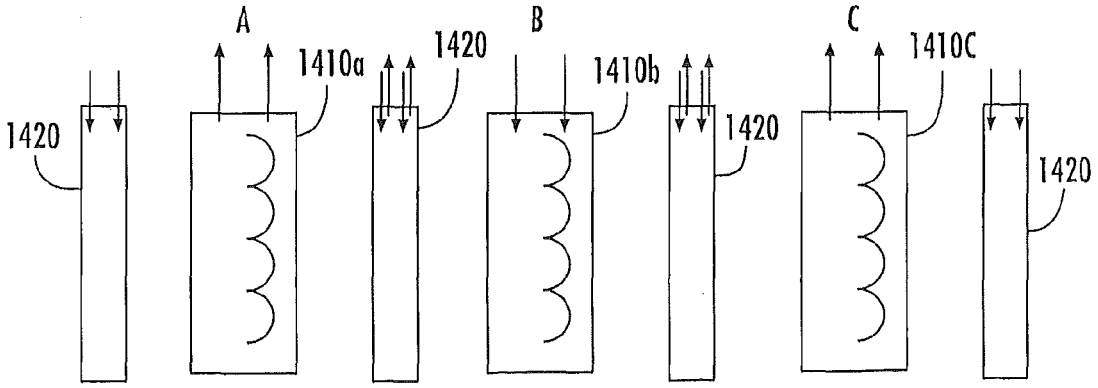
FIG. 14 illustrate a multi-phase inductor system according to some embodiments of the inventive subject matter.

According to further embodiments, flux concentrator bodies may be used in combination with parallel and antiparallel inductor arrangements. For example, FIG. 11 illustrates an inductor system 1100 including first and second inductors 1110*a*, 1110*b* that have a flux concentrator body 1120 positioned therebetween, along with two additional flux concentrator bodies 1120 positioned on outer sides of the inductors 1110. As shown in FIGS. 12 and 13 for respective first and second sizes of the flux concentrator bodies 1120, such an arrangement can increase flux density at the flux concentrator bodies 1120 and reduce field strength away from the inductors 1110*a*, 1110*b*. FIG. 14 illustrates an arrangement that may be used, for example, in a three-phase inverter or rectifier, in which inductors 1410*a*, 1410*b*, 1410*c* for respective A,B and C phases are arranged in an antiparallel fashion (i.e., fluxes of adjacent inductors oppositely aligned) and have flux concentrator bodies 1420 interspersed therewith.

Figure 15:
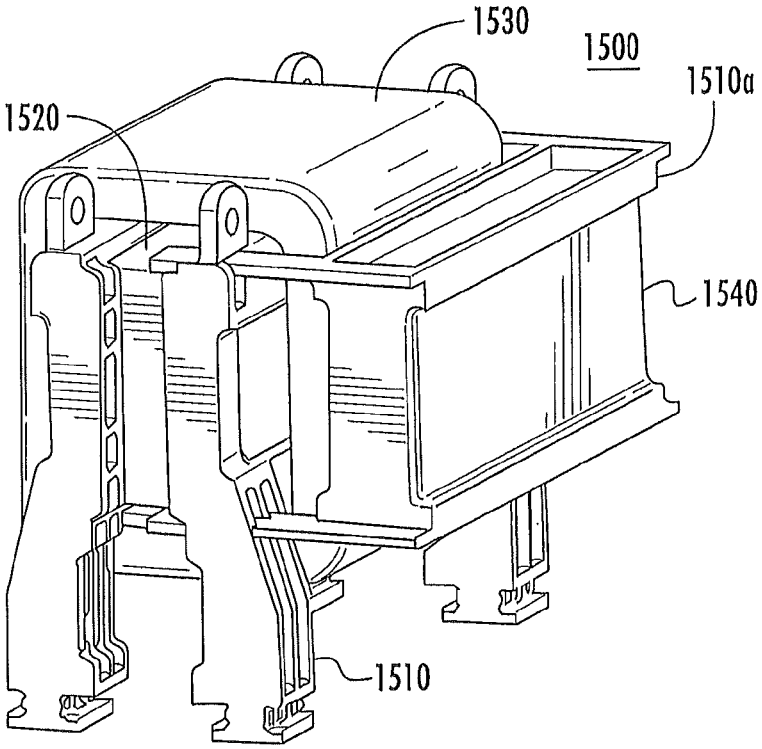
FIGS. 15 and 16 illustrate an inductor system with a side-mounted flux concentrator according to some embodiments of the inventive subject matter.
Figure 16:
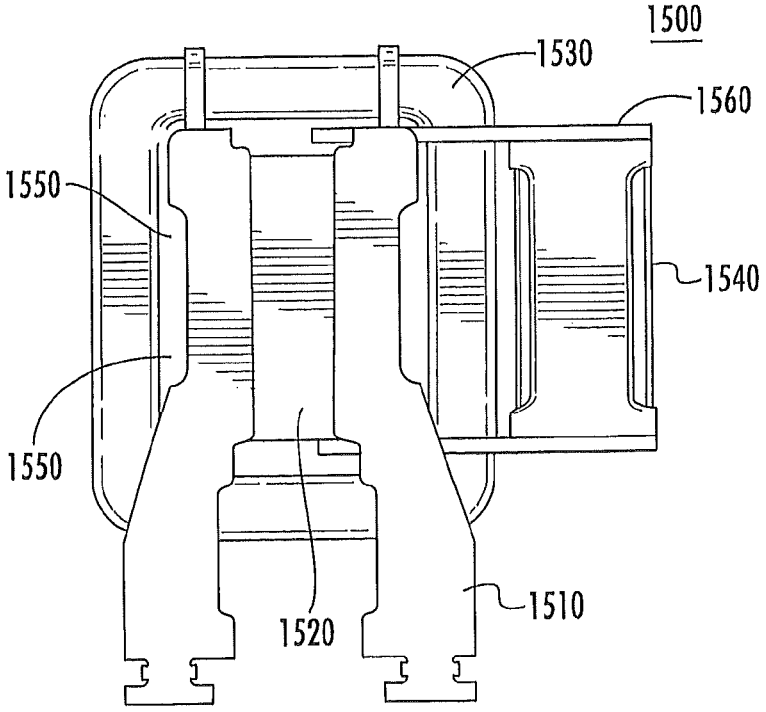
Figure 17:
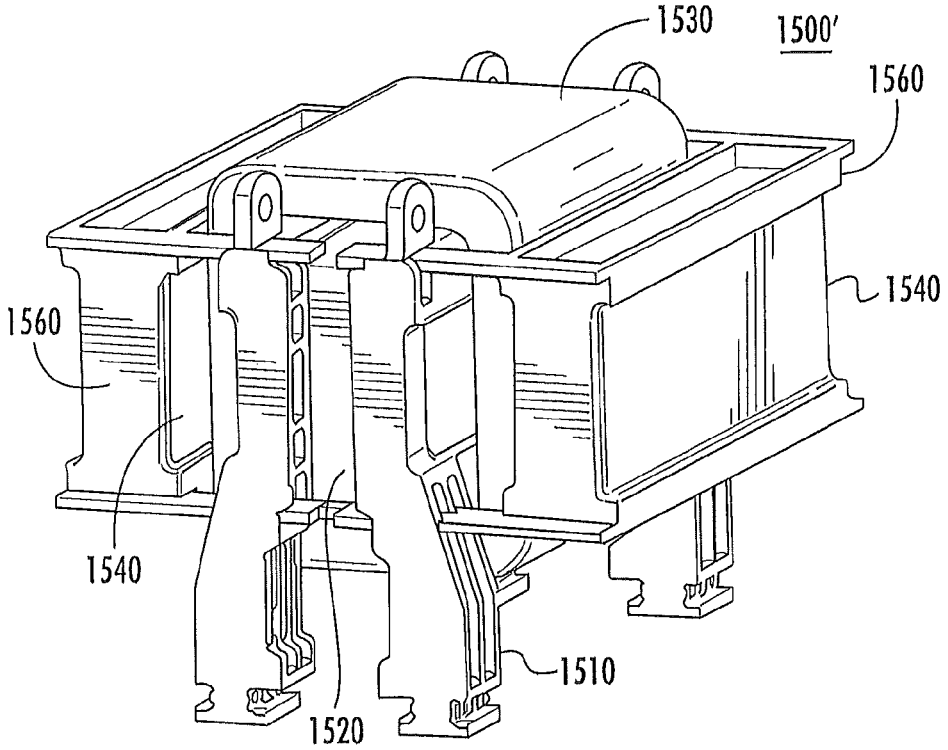
FIGS. 17 and 18 illustrate an inductor system with dual side-mounted flux concentrators according to some embodiments of the inventive subject matter.
Figure 18:
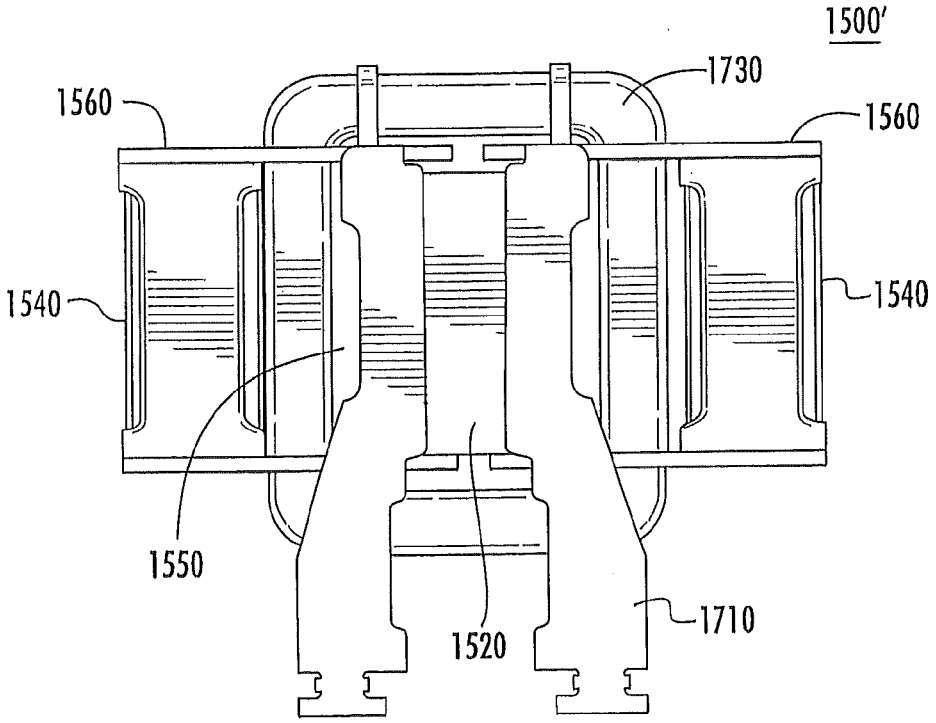

According to some embodiments, improved inductor systems may be obtained by modifying a structure along the lines illustrated in FIGS. 1 and 2 to include ancillary flux concentrator bodies that are supported by the same structure that supports the magnetic core and the winding(s) of the inductor. For example, FIGS. 15 and 16 illustrate an inductor system 1500 including a bar-shaped rectangular core 1520 formed of a magnetic material (e.g., ferrite), which is supported by a bobbin-like frame 1510. One or more coils 1530 are wrapped around the bobbin 1510, which spaces the coil(s) 1530 away from the core 1520 to provide one or more coolant (air) passages 1550. The inductor system 1500 further includes a saddlebag-type retainer 1560, which is configured to hold a rectangular flux concentrator body 1540, e.g., a ferrite bar, such that it extends parallel to the core 1520. The retainer 1560 may be an integral part of the bobbin 1510 or may be a separate piece configured to be mounted on or attached to the bobbin 1510 using, for example, fasteners and/or a snap-fit arrangement (e.g., interlocking slots and tabs). As illustrated in FIGS. 17 and 18, in an inductor system 1500', rectangular flux concentrator bodies 1540 may be arranged on opposite sides of the core 1520 and coil(s) 1530 using respective retainers 1560, which may be integral to the bobbin frame 1510 or designed for attachment thereto. Such flux concentrator body arrangements can provide the electrical and magnetic benefits described above while allowing desired airflow to the core 1520 and coil(s) 1530.

According to some embodiments, the arrangement of inductors and flux concentrator bodies described above may be modularized to afford flexibility in application. For example, a common inductor core unit may be combined with an appropriate number of flux concentrator bodies depending on the electrical and mechanical constraints of the application. As noted above, frame assemblies may be modularized to allow for addition of flux concentrator bodies in various positions with respect to the common inductor core unit (e.g., as shown in FIGS. 15-18).

Figure 19:
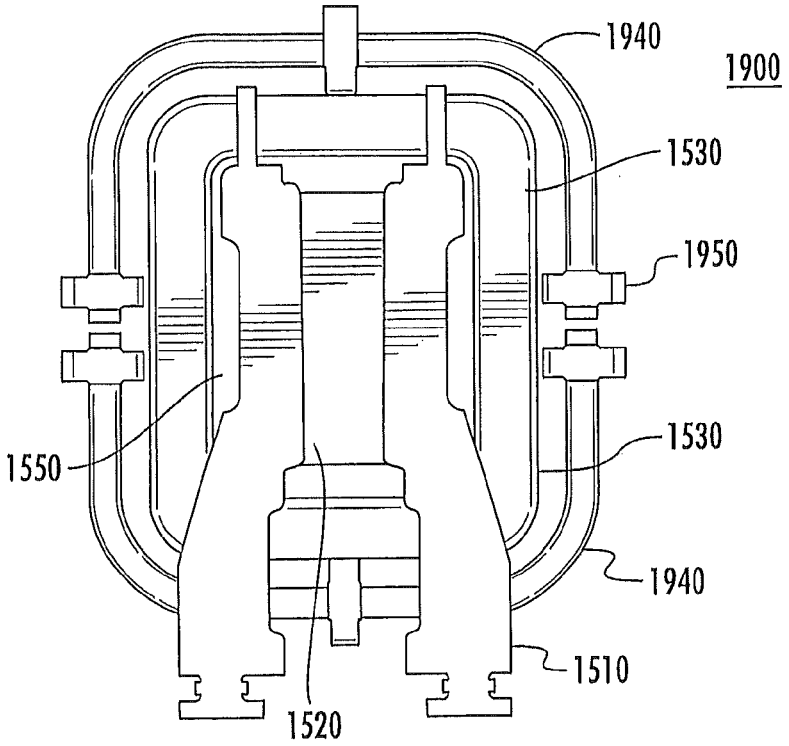
FIGS. 19 and 20 illustrate inductor systems with flux concentrators according to further embodiments of the inventive subject matter.

Further embodiments may use flux concentrator bodies with different shapes. For example, FIG. 19 illustrates an inductor system 1900 core inductor unit including a rectangular core 1520 and coil(s) 1530 supported by a bobbin 1510 as discussed above with reference to FIGS. 15 and 16. The inductor system 1900 further includes flux concentrator bodies 1940 that have an arcuate shell-like shape and that partially encircle the core 1520 and coil(s) 1530. The flux concentrator bodies 1940 may be spaced apart from the coil(s) 1530 by spacers 1950, and are supported by the bobbin 1510.

Figure 20:
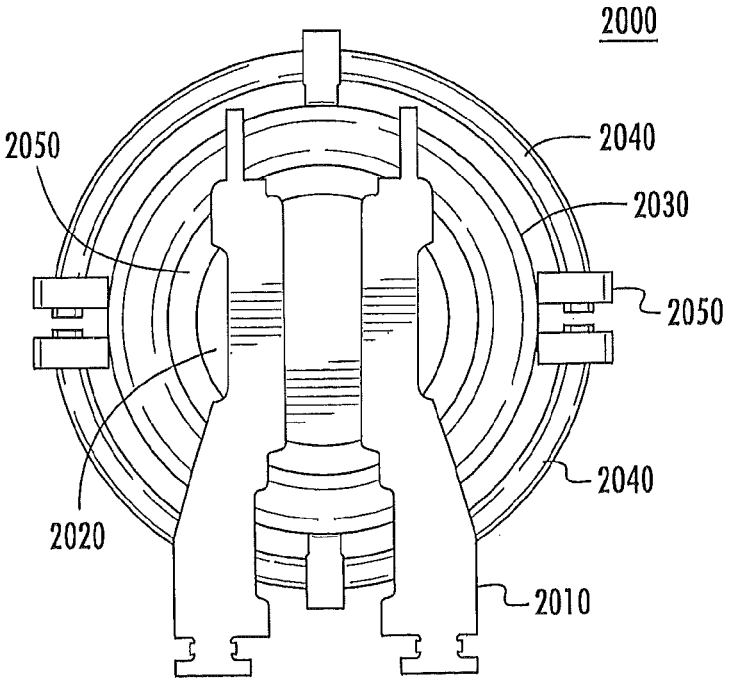

FIG. 20 illustrates an inductor system 2000 with a similar arrangement wherein the basic inductor structure includes a circular cross section rod-shaped magnetic core 2020 that is supported by a bobbin 2010, around which one or more circular coils 2030 is disposed, providing at least one coolant passage 2050 on an inner side of the coil(s) 2030. Flux concentrator bodies 2040 are disposed on an outer side of the coil(s) 2030, and take the form of arcuate shells with a semicircular cross-section. The flux concentrator bodies 2040 may be supported and spaced apart from the coil(s) 2030 by spacers 2050.

Figure 21:
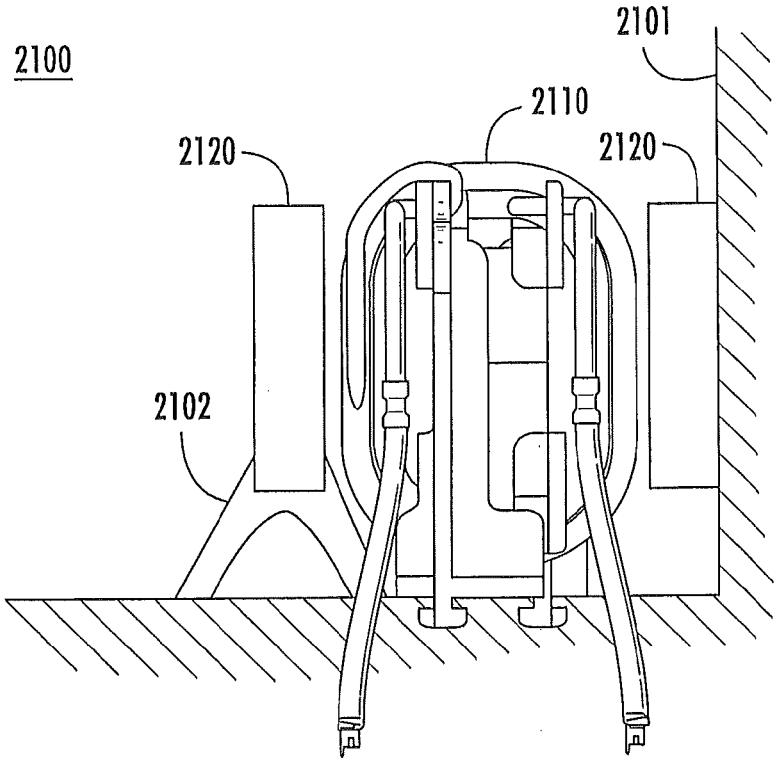
FIG. 21 illustrates an inductor system with an enclosure wall-mounted mounted flux concentrator according to further embodiments of the inventive subject matter.

According to further embodiments, inductor systems may use one or more flux concentrator bodies that are attached to surrounding structures, rather than directly supported by the core inductor unit structure. For example, FIG. 21 illustrates an inductor system 2100 that includes an inductor 2110 similar to that shown in FIGS. 1 and 2, with at least one flux concentrator body 2120 affixed to an adjacent wall 2101, which may be, for example, a wall of an electronics chassis or enclosure. As further illustrated, an additional flux concentrator body 2120 may be mounted on another side of the inductor 2110 using, for example, a support 2102. It will be appreciated that the arrangement of FIG. 21 is provided for purposes of illustration, and that inductor systems may use flux concentrator bodies mounted to surrounding structures in any of a number of different ways.

Figure 22:
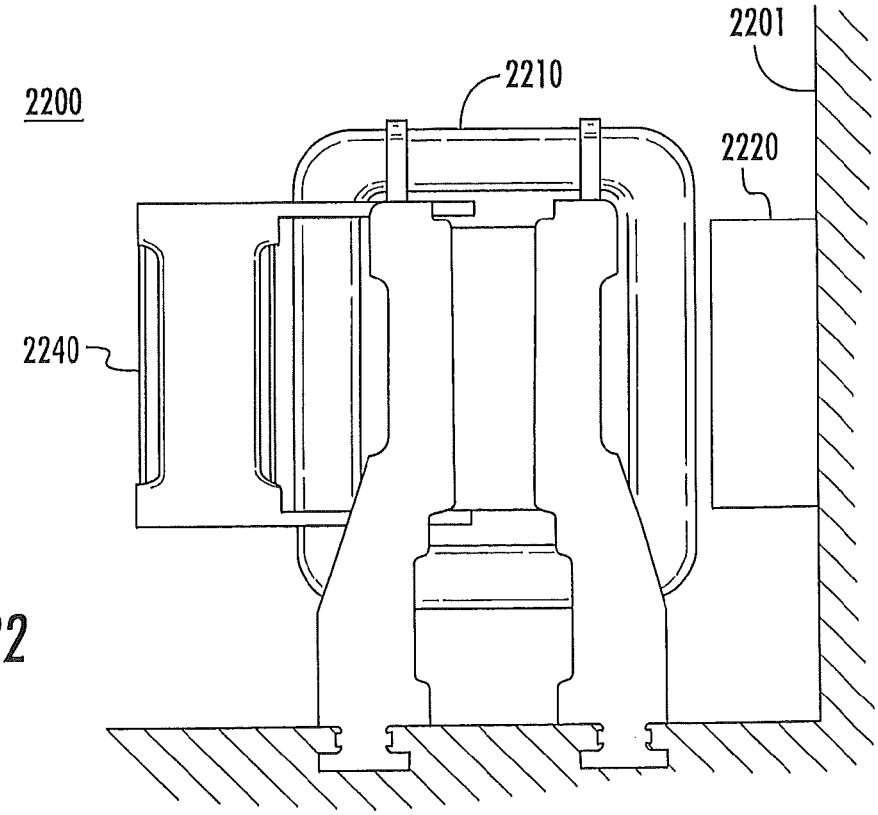
FIG. 22 illustrates an inductor system with a combination of a saddlebag mounted flux concentrator body and a wall-mounted flux concentrator body according to some embodiments of the inventive subject matter.

Some embodiments may include a combination of flux concentrator bodies supported by the main inductor structure and by adjacent structures. For example, referring to FIG. 22, an inductor system 2200 may include an inductor 2210 having a flux concentrator body 2240 mounted on one side thereof along the lines described with reference to FIGS. 15 and 16. An additional flux concentrator body 2220 may be mounted on an enclosure or chassis wall 2201 on another side of the inductor 2210.

Various embodiments of the inventive subject matter can provide a flexible inductor system arrangement in which a basic inductor structure can be tailored to a variety of different applications by selective design and placement of flux concentrator bodies. For example, as described above, inductor systems may be tailored for different power/current levels and enclosure/chassis arrangements while utilizing a common inductor core and coil arrangement.

Figure 23:
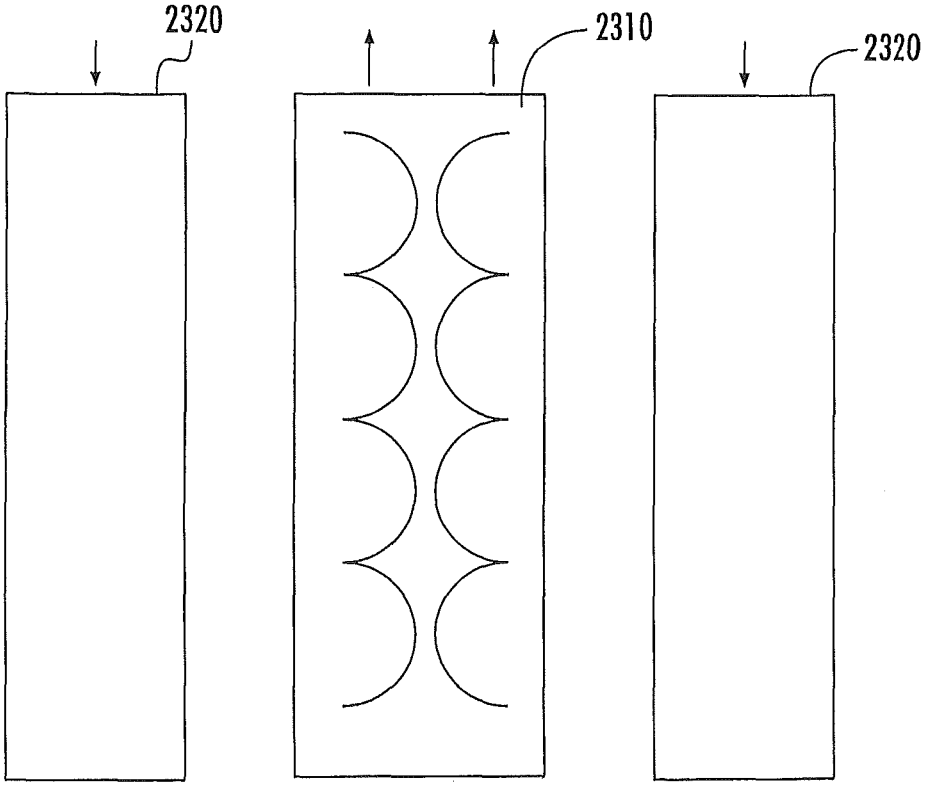
FIG. 23 illustrates a transformer system with flux concentrator bodies according to some embodiments of the inventive subject matter.

It will be appreciated that other inductor systems, such as transformers and magnetically coupled inductors, may utilize flux concentrator arrangements along lines described above. For example, referring to FIG. 23, a transformer 2310 may use multiple electrically isolated coils wrapped around a bar- or rod-shaped common magnetic core along the lines described above. One or more flux concentrator bodies 2320 may be positioned adjacent the transformer 2310 to provide near field flux concentration and far field attenuation.

Figure 24:
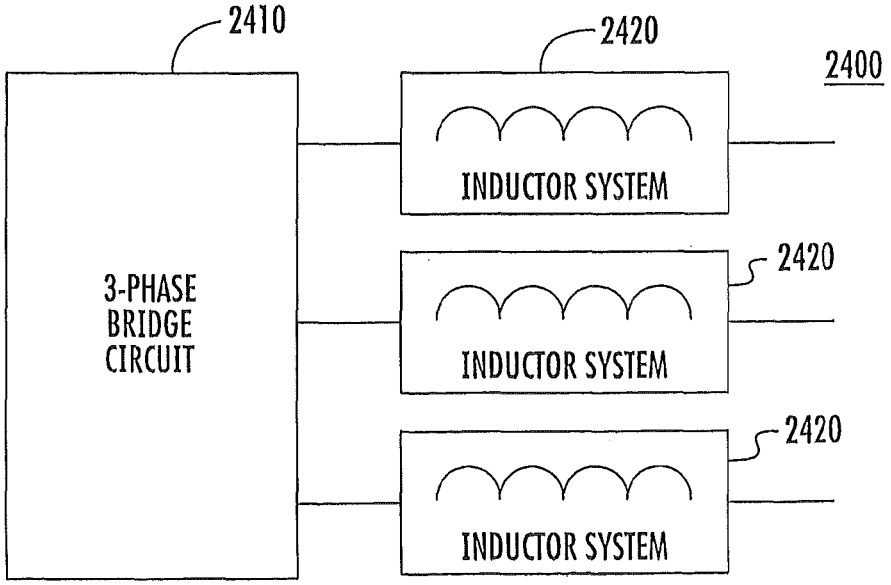
FIG. 24 illustrates a power conversion circuit application of inductor systems according to further embodiments of the inventive subject matter.

Inductor systems according to some embodiments of the inventive subject matter may be used in a variety of different applications, such as in rectifiers, inverters and other power conversion circuits. For example, FIG. 24 illustrates a three-phase inverter 2400 in which a three-phase bridge circuit 2410 is coupled to respective inductor systems 2420 that provide respective phase outputs. The inductor systems 2420 may be standalone systems and/or may include shared flux concentrator bodies, such as illustrated in FIG. 14. It will be understood that inductor systems according to embodiments of the inventive subject matter may be used in any of a variety of other applications, such as in rectifiers, DC/DC converters, motor drives, battery chargers and the like.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

What is claimed is:

1. An apparatus comprising:

a bar of magnetic material;

at least one coil wrapped around the bar of magnetic material;

a spacer spacing an inner side of the at least one coil apart from the bar of magnetic material such that a coolant passage exposing the inner side of the at least one coil and an outer surface of the bar of magnetic material is disposed between the inner side of the at least one coil and the bar of magnetic material; and at least one mass of magnetic material positioned on an outer side of the at least one coil so as to not overlap ends of the bar of magnetic material, wherein the at least one mass of magnetic material is not surrounded by another coil.

2. The apparatus of claim 1, further comprising a frame configured to support the bar of magnetic material, the at least one coil and the at least one mass of magnetic material.

3. The apparatus of claim 1, wherein the bar of magnetic material comprises a first bar of magnetic material and wherein the at least one mass of magnetic material comprises at least one second bar of magnetic material positioned parallel to the first bar of magnetic material.

4. The apparatus of claim 3, wherein the first bar of magnetic material comprises a first ferrite bar and wherein the at least one second bar of magnetic material comprises at least one second ferrite bar.

5. The apparatus of claim 3, wherein the first bar of magnetic material and/or the at least one second bar of magnetic material is rectangular.

6. The apparatus of claim 1, wherein the at least one mass of magnetic material comprises at least one arcuate shell of magnetic material at least partially encircling the at least one coil and the bar of magnetic material.

7. The apparatus of claim 6, wherein the bar of magnetic material and the arcuate shell of magnetic material each comprise a ferrite material.

8. The apparatus of claim 6, wherein the bar of magnetic material is rectangular or circular in cross section.

9. The apparatus of claim 1, wherein the at least one mass of magnetic material is mounted on at least one wall of an enclosure or chassis.

10. An apparatus comprising:

an inductor comprising:

a first straight bar of magnetic material;

a frame configured to support the first straight bar of magnetic material; and at least one coil wrapped around the frame such that the frame separates an inner side of the at least one coil from the first straight bar of magnetic material such that a coolant passage exposing the inner side of the at least one coil and an outer surface of the first straight bar of magnetic material is disposed between the at least one coil and the first straight bar of magnetic material; and at least one second straight bar of magnetic material positioned on an outer side of the at least one coil in parallel with the first straight bar of magnetic material, supported by the frame, and not surrounded by another coil.

11. The apparatus of claim 10, wherein the at least one second straight bar of magnetic material comprises two second straight bars of magnetic material positioned on opposite sides of the magnetic core.

12. The apparatus of claim 10, wherein the first straight bar comprises a first ferrite bar and wherein the at least one second straight bar comprises a second ferrite bar.

13. The apparatus of claim 10, wherein the first straight bar and/or the at least one second straight bar is rectangular.

14. The apparatus of claim 3, wherein the at least one second bar of magnetic material is longer than the first bar of magnetic material.

15. The apparatus of claim 3, wherein the at least one second bar of magnetic material comprises two second bars of magnetic material disposed on respective first and second sides of the first bar of magnetic material.

16. The apparatus of claim 15, wherein the two bars of magnetic material are each longer than the first bar of magnetic material.

17. The apparatus of claim 10, wherein the at least one second straight bar of magnetic material is longer than the first straight bar of magnetic material.

* * * * *